US006874299B2

(12) United States Patent
Basque

(10) Patent No.: US 6,874,299 B2
(45) Date of Patent: Apr. 5, 2005

(54) HIGH SPEED BAGGING SYSTEM AND METHOD

(75) Inventor: Roland Basque, Brossard (CA)

(73) Assignee: Glopak Inc., Montreal (CA)

( * ) Notice: Subject to any disclaimer, the term of this patent is extended or adjusted under 35 U.S.C. 154(b) by 0 days.

(21) Appl. No.: 10/447,926

(22) Filed: May 29, 2003

(65) Prior Publication Data

US 2004/0237473 A1 Dec. 2, 2004

(51) Int. Cl.[7] ..... B65B 11/58; B65B 5/10; B65B 35/54

(52) U.S. Cl. ..... 53/449; 53/475; 53/171; 53/202; 53/154

(58) Field of Search ..... 53/449, 173, 171, 53/174, 443, 451, 475, 202, 237, 154; 198/778, 570, 369.2

(56) References Cited

U.S. PATENT DOCUMENTS 3,859,772 A * 1/1975 Thierion ..... 53/443
3,987,604 A * 10/1976 MaGill ..... 53/113
4,043,442 A * 8/1977 Greenwell et al. ..... 198/418.1
4,124,967 A * 11/1978 Beer et al. ..... 53/446
4,829,745 A * 5/1989 Behr et al. ..... 53/451
5,031,751 A * 7/1991 Pahlsson ..... 198/570
5,078,255 A * 1/1992 Haley ..... 198/358
5,813,196 A * 9/1998 Page et al. ..... 53/448
5,878,554 A * 3/1999 Loree et al. ..... 53/540
5,909,796 A * 6/1999 Soldavini ..... 198/369.2
6,006,501 A * 12/1999 Davis et al. ..... 53/451
6,371,275 B1 * 4/2002 Terrell et al. ..... 198/367
6,619,017 B2 * 9/2003 Franzaroli ..... 53/435

FOREIGN PATENT DOCUMENTS

JP 54132970 * 10/1979 ..... B65G/47/57

* cited by examiner

*Primary Examiner*—Eugene Kim
*Assistant Examiner*—Paul Durand
(74) *Attorney, Agent, or Firm*—Carter Schnedler & Monteith, P.A.

(57) ABSTRACT

A high speed bagging system and a method for placing a liquid product into a bag and placing at least two of these bags into a pouch is described. The system comprises at least two bag fillers housed in a common filler housing and operating simultaneously to place the liquid product in respective bags on a continuous basis during a working cycle. Filled bags are simultaneously conveyed on a two lane conveyor system. The two-lane conveyor is configured to optimize floor space area. Each conveyor belt has an outlet end associated with a respective bagging machine at a bagging station. The bagging machines are adapted to place at least two of the bags into a pouch on a continuous basis during the working cycle. The bagging machines feed a respective pouch closure device to close a mouth opening of the pouches which are then discharged on a discharge conveyor.

18 Claims, 4 Drawing Sheets

HIGH SPEED BAGGING SYSTEM AND METHOD

TECHNICAL FIELD

The present invention relates to a high speed bagging system and method, and particularly, but not exclusively, for bagging milk and wherein the system can operate at higher output speeds than known prior art systems and further wherein the bagging system of the present invention optimizes floor space area and is ergonomic to a service person who can maintain two of these systems operative.

BACKGROUND ART

In the milk bagging industry, the current practice is to use twin-head bag forming, filling and sealing machines to bag milk at high speeds. The current speed of operation of such machine is about 120 bags per minute. However, there is a need to increase this speed in existing facilities having restricted space area. There are several problems in increasing the speeds of these machines as an increase in the bagging necessitates an increase in the speed of the conveyors. When the conveyor speeds are increased, the bags slip and pile up on one another. The bag slippage is due to the high speed of the conveyors and the fact that these bags are formed of polyethylene which is slippery, and have a flexible product inside, such as water or milk. Accordingly, increasing the speed of the conveyor has not proved to be a viable solution.

These bagging systems of the prior art also feed a bagging machine which places at least two and sometimes three of these bags into another plastic pouch which is then applied a locking tab to close its mouth opening and the pouch is then released on a discharge conveyor. Therefore, the assembly line is dependent on the continuous operation of several machines in order to maintain its rate of production. There is therefore much down-time in the assembly line as the bag filling machine needs to be serviced whenever a roll of film needs to be installed, and the baggers also need to be provided with a supply of bags and if there is a malfunction in the operation, then the bagger needs to be serviced and this also applies to the lock tab applying machine which needs to be loaded with locking tabs and also needs to be serviced in the event of malfunction. Also, these baggers need to have their bags changed if there is a need to change labels on the bag, such as to identify a new brand. Therefore, the bagger and the filler need to be stopped while the bags on the bagging machine are changed. Another disadvantage of the equipment of known systems is that they are not ergonomically positioned for servicing by a single person.

SUMMARY OF INVENTION

It is a feature of the present invention to provide a high speed bagging system and method which substantially overcomes the above-mentioned disadvantages of the prior art.

Another feature of the present invention is to provide a high output speed bagging system and method which can operate at higher speed outputs than those of the prior art and capable of producing filled bags at a rate of at least 140 bags per minute.

Another feature of the present invention is to provide a high output speed bagging system and method which can operate substantially on a continuous basis regardless if film rolls have to be installed in the filling machines or if film bags have to be installed on the baggers or if one filler is stopped, etc. Accordingly, the production is continuous.

Another feature of the present invention is to provide a high output speed bagging system and method which optimizes floor space area and which equipment is ergonomically disposed.

Another feature of the present invention is to provide a high output speed bagging system and method and wherein a single service person can operate two of these high speed bagging systems disposed such as to optimize floor space area and accessibility to a service person.

According to the above features, from a broad aspect, the present invention provides a high output speed bagging system for placing a product into a bag and placing at least two of these bags into a pouch. The system comprises at least two bag fillers operating simultaneously to place the product in respective bags and sealing the bags on a continuous basis during a working cycle. Filled bags are conveyed simultaneously on a two-lane conveyor disposed elevated one above the other in distinct spaced planes. The two-lane conveyor has an elevated spiral configuration in a section thereof to optimize floor space area. Diverting conveyor means is associated with each of the two bag fillers for directing the filled bags to a selected one of the two conveyor lanes. Each conveyor lane has an outlet end associated with a respective bagging machine at a bagging station. The bagging machines are adapted to place at least two of the bags into a pouch on a continuous basis during the working cycle. The bagging machines feed a respective pouch closure device to close a mouth opening of the pouches. A discharge conveyor means is provided for discharging the pouches. The spiral configuration provides for the outlet end of the conveyor belts to be elevated to feed the filled baas into a too loading end of the bagging machines. The bagging machines and pouch closure device are supported elevated from a floor surface for service access to an operator person.

According to a further broad aspect of the present invention there is provided a method of continuously bagging filled bags into pouches. The method comprises the steps of filling bags with a liquid product from at least two bag fillers operating simultaneously and sealing the filled bags on a continuous basis during a working cycle. The filled bags are directed by diverting conveyor means to a selected one of two conveyor lanes. The two conveyor lanes are disposed in an elevated spiral circular loon configuration in a section thereof between the baa fillers and a bagging station whereby to optimize floor space area. The filled bags are conveyed on the two-lanes with each conveyor lane having an outlet end associated with a respective bagging machine at the bagging station. Bags are continuously discharged from the outlet ends in a collating bag receiver of an associated one of the bagging machines. The bagging machine places at least two of the bags into pouches on a continuous basis during the working cycle. The pouches are transferred with the at least two bags therein into a respective pouch closure device to close a mouth opening of the pouches. The closed pouches are discharged on a discharge conveyor means. The outlet end of each of the two conveyors are elevated above a top loading end of the bagging machines. The bagging machines are supported elevated from a floor surface for service access to an operator person. There is further provided the step of disabling one of the bagging machines and diverting the filled bags of both of the at least two bag fillers on a predetermined one of the conveyor lanes feeding the filled bags to the other bagging machine which is not disabled.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
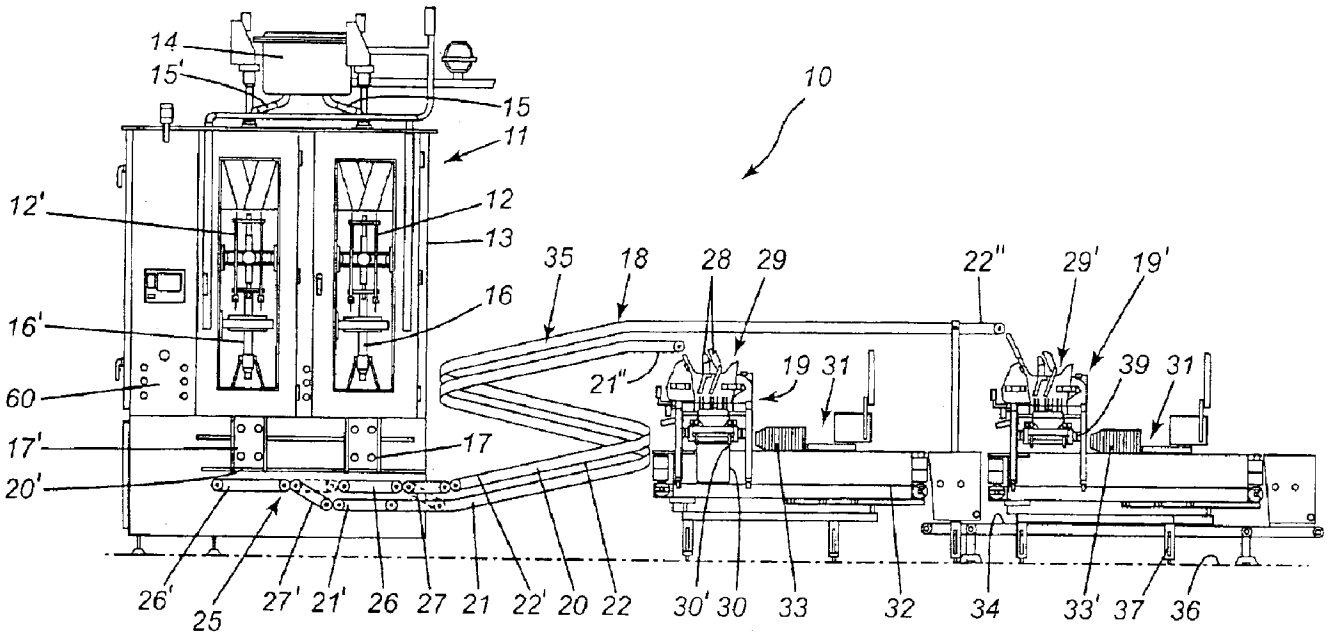
FIG. 1 is a side view of the high speed bagging system of the present invention.

Referring now to the drawings, and more particularly to FIG. 1, there is shown generally at 10 the high speed bagging system of the present invention. The system comprises a vertical form, fill and seal bagging machine 11 (VFFS) which comprises two bag forming, filling and sealing heads 12 and 12' housed in a common housing 13 for placing a liquid product, such as milk or water, into bags formed therein. The milk or water is fed from a holding tank 14 located at the top of the housing 13 and feeds the milk or water through feed conduits 15 and 15' feeding respective filler tubes 16 and 16'. The filled bags are then released in chutes 17 and 17', respectively, disposed over a conveyor system 18. These bag forming, filling and sealing machines are well known in the art and will not be described in more detail herein.

As previously described, such systems usually feed a single bagging machine such as one of the bagging machines 19 and 19' as hereinshown. However, in order to increase the discharge speed of filled bags 20, there is herein provided a novel conveyor system 18 and as hereinshown the conveyor 18 is a two-lane conveyor system having conveyor belt lanes 21 and 22, respectively. This two-lane conveyor 18 is configured to optimize floor space area as will be described.

The two-lane conveyor system 18 defines bag receiving ends 21' and 22', respectively, and an outlet end 21" and 22", respectively. Each outlet end 21" and 22" is associated with a respective one of the two bagging machines 19 and 19'.

The two-lane conveyor system 18 is further provided with a diverting conveyor section 25 under the chutes 17 and 17'. As hereinshown the diverting conveyor section comprises a receiving conveyor section 26 and 26', respectively, disposed under the chutes and feeding the filled bags 20 to the conveyor lanes 21 or 22 or both conveyor lanes 21 and 22 depending on the position of the diverting conveyor sections 27 and 27' associated with the receiving conveyor sections 26 and 26', respectively. Accordingly, if one of the bagging machines 19 or 19' is idle due to a bag change or for servicing, or for any other reason, then the diverting conveyor sections will be actuated to feed all of the bags from the bagging machine 11 to a single conveyor lane feeding the other bagger which is capable of bagging at very high speeds. The filling machine can also be slowed down, if necessary. Accordingly, with one bagging machine idle, the system is still operative. The bagging system can operate on a substantially continuous basis even with one of the filling heads idle.

It is also pointed out that these bagging machines 19 and 19' are well known in the art and are provided with gates 28 in a top collating receiver 29 and operated automatically as soon as pouches are fed on these gates. Accordingly, the speed of operation of the bagger is dependent on the bag discharge speed at the outlet end 21" and 22" of the conveyor lanes. These collating receivers are also adapted to place two or three or more bags in a single pouch 30 supported thereunder in an open position, as is well known in the art. Once the predetermined quantity of bags have been placed in the pouch 30, the pouch is then fed to a pouch closing machine 31 wherein the pouch 30 is advanced by a conveyor 32 to place the top part 30' of the pouch into the pouch closing machine whereby the top open end 30' is gathered by brushes 33 or other gathering means and a lock tab (not shown) is applied to the gathered top end of the bag. The closed bag is then advanced and discharged on a discharge conveyor 34.

Figure 2:
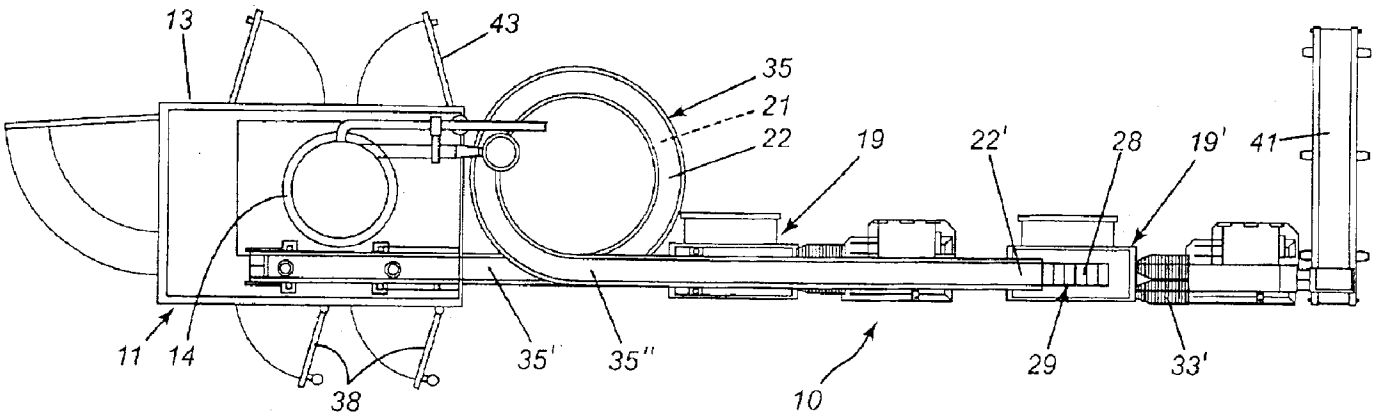
FIG. 2 is a top view of FIG. 1.
Figure 4:
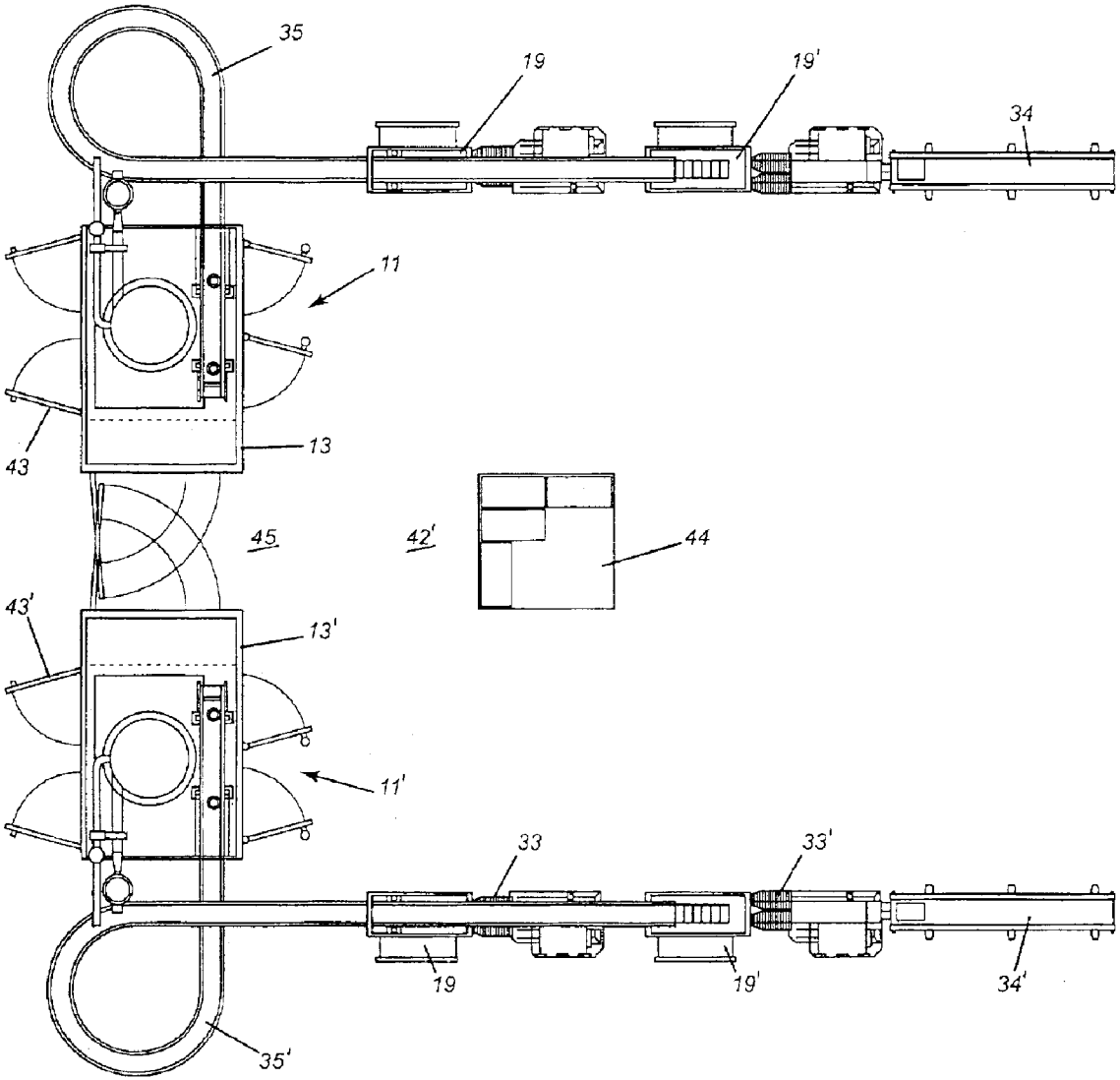
FIG. 4 is a top view showing two high speed bagging systems disposed side-by-side but wherein the spiral configuration of the conveyor defines a travel path of 270°.

As previously described, the high output speed bagging system of the present invention is also configured to optimize floor space area. In order to achieve this, the two-lane conveyor system 18 is provided with an elevated spiral configuration 35 as better shown with further reference to FIG. 2 and disposed between the filler housing 13 and the first bagging machine 19. The spiral configuration 35 as shown in FIG. 2, and forms a circular loop having a lower entry section 35' and a top outlet section 35" disposed to define a travel path in the circular loop of approximately 360° between the entry and outlet sections 35' and 35", respectively. With reference to FIG. 4, it can be seen that the circular loop 35 may also have its inlet and outlet section disposed such as to define an approximately 270° travel path between the entry and the outlet. Of course, the travel path may have any other suitable disposition.

Figure 3:
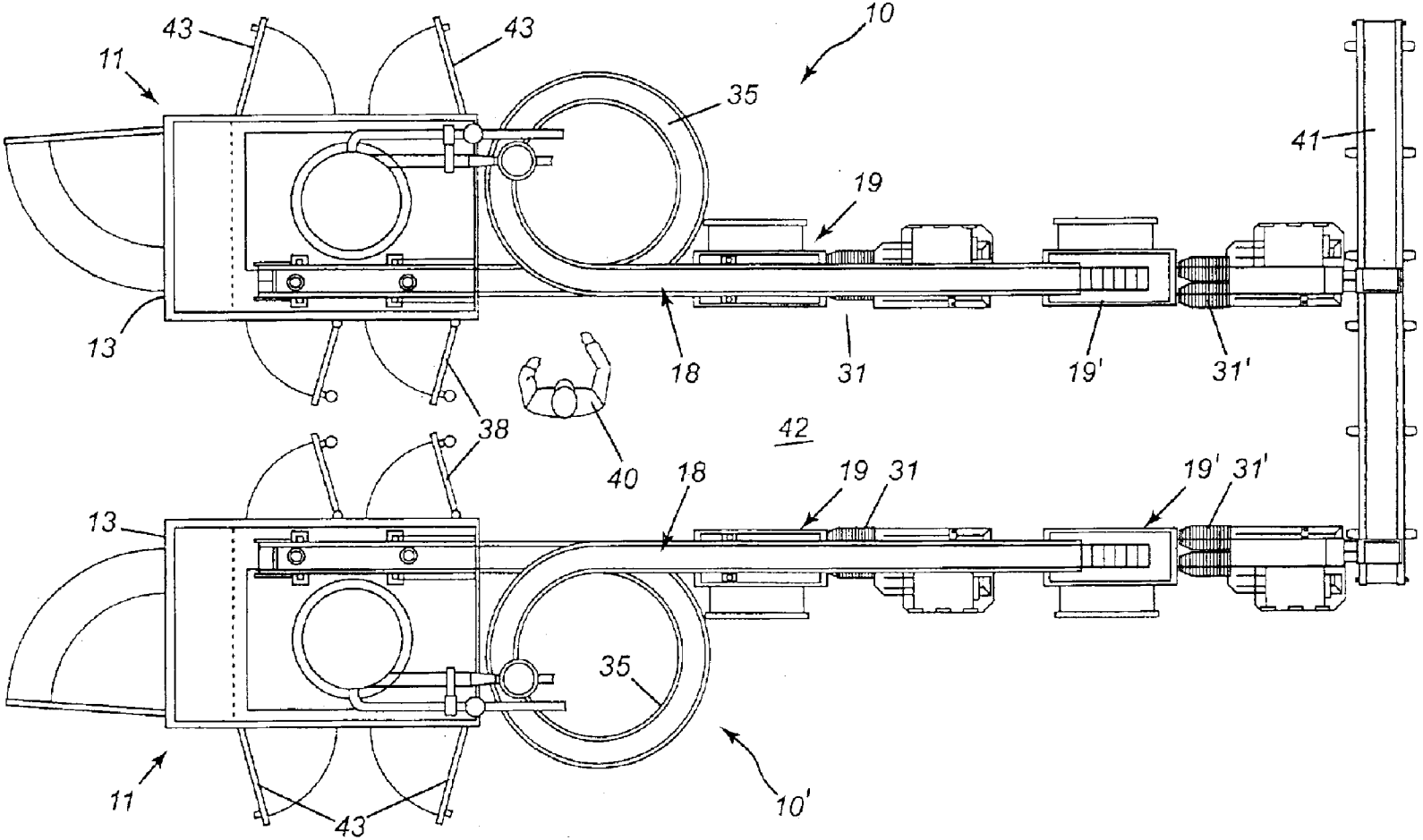
FIG. 3 is a top view showing two high speed bagging systems disposed side-by-side and wherein the conveyor has a spiral configuration which defines a travel path of 360° and wherein the two bagging systems are disposed side-by-side and parallel relationship and serviced by a single attendant.

The spiral configuration of the two-lane conveyor system permits the conveyor lanes 21 and 22 to be elevated in different planes and spaced one on top of the other or side-by-side to feed filled bags into the top collating receivers 29 and 29' of the bagging machines 19 and 19', respectively. As can be seen, the bagging machines are supported elevated from the floor surface 36 by an adjustable frame 37 and this provides ease of access to an operator person as the bagging machines are disposed at a working height facilitating the change of pouches and the servicing of the baggers as well as the pouch closing machines and associated conveyor equipment. Also, the spiral configuration permits for the bagging machines to be close to the filling machine and as shown in FIG. 2, the complete bagging system is disposed in a straight line configuration with the housing 13 having its access doors 38 disposed on a common side of the wicket pins 39 of the baggers which holds a supply of pouches. This provides for two of these systems 10 and 10' to be disposed in close parallel relationship, as shown in FIG. 3, and wherein the access doors of both housings 13 face one another whereby the single attendant person 40 can service both lines. Accordingly, the cost of operation is greatly reduced as well as savings in floor space area where possible and while achieving higher production output. Both of these systems also feed a common outlet conveyor 41.

As can also be seen in FIG. 3, the service area 42 can be made very narrow as the supply of film rolls is located outside the service area as these film rolls are loaded from the backside of the housing 13 through the access doors 43.

With reference now to the configuration as illustrated in FIG. 4, it can be seen that with the loops oriented at 270° there is more space in the service area 42' and wherein skids 44 of supply rolls and bags may be disposed. The housings 13 and 13' of both systems are spaced a predetermined distance to define a passage 45 sufficient to permit machinery, such as a forklift truck, to pass therethrough to load the heavy film supply rolls through the access doors 43 of each of the bag filling machines 11 and 11'. It is pointed out that the discharge conveyors 34 and 34' are also associated with an outlet conveyor 41 as illustrated in FIG. 3.

Figure 5:
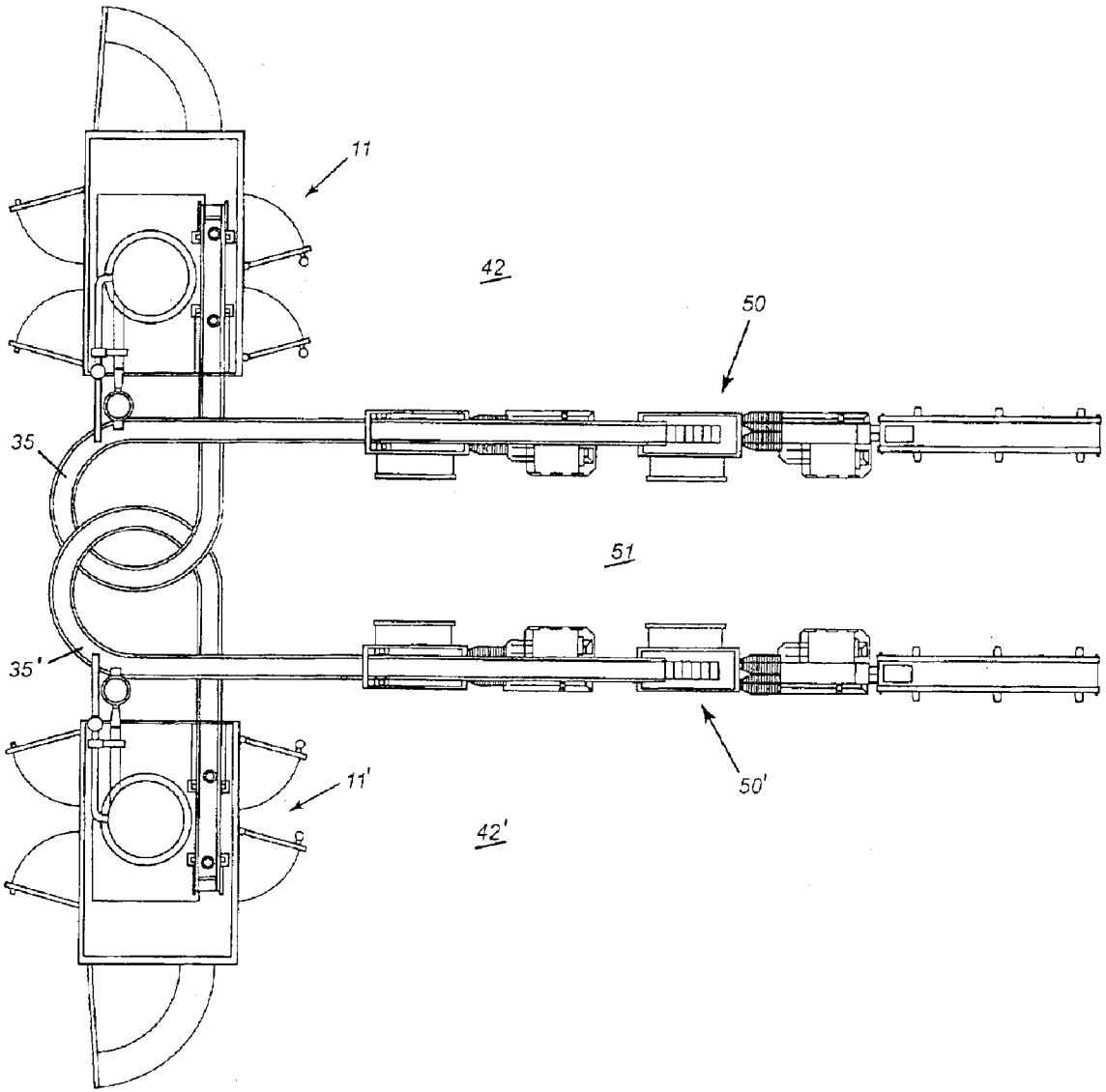
FIG. 5 is a view similar to FIG. 4 but showing how pairs of these bagging systems may be disposed in close spaced side-by-side relationship with the spiral sections of the conveyor overlapping one another.

If there is a need to dispose a plurality of high speed bagging systems as shown in FIG. 4 in side-by-side relationship, then in order to further optimize floor space area the spiral configuration 35 and 35' of adjacent conveyors are formed such as to overlap, as shown in FIG. 5, whereby adjacent lines 50 and 50' can be more closely spaced but still providing a bag access area 51 for servicing. In order to overlap the sections, the angles of the inclined conveyors in the circular loop section 35 are varied from one another and it has been found that these conveyors may be positioned at angles between 12° and 20° to function adequately and prevent slippage of the filled bags thereon. Therefore, by varying the angle of one of the conveyors in the loop, these loops can be made to overlap. Also, because of the two-lane conveyor belts it is not necessary to increase conveyor speeds to achieve high output production. As shown in FIG. 5, each of the service areas 42 and 42', on each side, services up to four conveyor lanes as these conveyor layouts are positioned side-by-side. For example, the configuration of FIGS. 4 and 5 may be disposed next to one another. Therefore, the operator at the service area 42 would service the two lanes at 50 and two lanes of the adjacent layout of FIG. 4. As previously described, the pouches may contain printed label material which identify different brands or suppliers. As well, the film supply rolls feeding the fillers 11 and 11' may also be dedicated rolls to identify different suppliers or proprietors.

The method of operation of the high speed bagging system of the present invention will now be summarily described. The method comprises filling bags with a product, herein a liquid product, such as milk, juices, water, etc., and discharging these bags on two conveyor belts 21 and 22 of the two-lane conveyor system 18. The bag filling machines have two filling heads 12 and 12' operating simultaneously on a continuous basis during a working cycle. The filled bags 20 are conveyed on the two-lane conveyor system 18 to an outlet end 21" and 22" associated with a respective bagging machine, ergonomically disposed at a bagging station. The filled bags are discharged into a collating bag receiver 29 and 29' of the bag machines 19 and 19', respectively. These collators continuously receive bags and discharge two or more of these bags into an open pouch 30 retained under a gate in a lower end of these bagging machines. The pouches 30 are then conveyed into a pouch closing machine 31 to close an open mouth opening 30' of the pouches and apply a closing tab thereto. The pouches are then transferred onto a discharge conveyor.

If one of the bagging machines 19 or 19' is idled to effect a bag change or for any other reasons, then the diverting conveyor sections 27 and 27' are actuated whereby to divert all of the filled bags 20 of both filler heads 12, on a common one of the conveyor belts 21 or 22 to feed the other bagging machine. The filling machine can also be slowed down. The method also comprises disposing these high speed bagging systems such as to define a service area wherein two of these systems, each comprising of one filling machine, can be serviced by a single attendant and to optimize floor space area and cost of operation.

With the system as above-described, production speed of the filling machine can be optimized and the output of these machines can produce up to 140 filled 1.3 litre bags per minute. It is also possible with this system to fill pouches having different labels thereon, during a production run. The disposition of the equipment makes the system ergonomic and easy to maintain by an operator person. The service area also provides for the handling of film rolls and film pouches easier to the operator, as the equipment is closely packaged or layed out and there is no need to have two operators for operating two lines as with the prior art. As above-described a single operator can service two systems operating at a higher speed. Speeds up to 144 1.3 litre pouches per minute have been attained with a single line as above-described. The entire line can also be operated from a single control panel 60 as illustrated in FIG. 1.

A most important aspect of this system is that the use of two conveying lanes in combination with a directing conveyor assures continuous operation or production even when one of the fillers or baggers is idle for whatever reason. A controller can monitor the VFFS fillers and baggers and control the position of the diverting conveyor to maintain proper production, as explained above.

It is within the ambit of the present invention to cover any obvious modifications of the preferred embodiment described herein provided such modifications fall within the scope of the appended claims.

What is claimed:

1. A method of continuously bagging filled bags into pouches, said method comprising the steps of:

i) filling bags with a liquid product from at least two bag fillers operating simultaneously and sealing said filled bags on a continuous basis during a working cycle, ii) directing said filled bags by diverting conveyor means to a selected one of two conveyor lanes, said two conveyor lanes being disposed in an elevated spiral circular loop configuration in a section thereof between said bag fillers and a bagging station whereby to optimize floor space area, iii) conveying said filled bags on said two-lanes, each conveyor lane having an outlet end associated with a respective bagging machine at said bagging station, iv) continuously discharging bags from said outlet ends in a collating bag receiver of an associated one of said bagging machines, said bagging machine placing at least two of said bags into pouches on a continuous basis during said working cycle, v) transferring said pouches with said at least two bags therein into a respective pouch closure device to close a mouth opening of said pouches, vi) discharging said closed pouches on a discharge conveyor means, said outlet end of each said two conveyors being elevated above a top loading end of said bagging machines, said bagging machines being supported elevated from a floor surface for service access to an operator person, there being further provided the step of (vii) disabling one of said bagging machines and diverting said filled bags of both said at least two bag fillers on a predetermined one of said conveyor lanes feeding said filled bags to the other bagging machine not disabled.

2. A method as claimed in claim 1 wherein said step (i) comprises forming a bag from a film roll, filling said bag with a liquid product and effecting said sealing of said filled bag, and discharging said filled bag on a bag receiving end of a selected one of said two conveyor lanes.

3. A method as claimed in claim 2 wherein said step (ii) further comprises diverting said filled bags to a selected one of said two conveyor lanes.

4. A method as claimed in claim 1 wherein there is further provided the step of disposing said two conveyor lanes in different planes one above the other whereby to optimize floor space area.

5. A method as claimed in claim 1 wherein there is further provided the steps of placing two of said bag fillers and associated two lane conveyor, bagging machines and closure device in aligned spaced side-by-side relationship to define a service area therebetween, and providing a single service person in said service area for servicing the machinery.

6. A method as claimed in claim 1 wherein there is further provided the step of loading distinct pouches on said two bagging machines and discharging said pouches with bags loaded therein onto an associated discharge conveyor.

7. A high output speed bagging system for placing a product into a bag and placing at least two of said bags into a pouch, said system comprising at least two bag fillers, said two bag fillers operating simultaneously to place said product in respective bags and sealing said bags on a continuous basis during a working cycle, simultaneously conveying filled bags on a two-lane conveyor having two conveyor lanes disposed elevated one above the other in distinct spaced planes; said two-lane conveyor having an elevated spiral configuration in a section thereof to optimize floor space area; diverting conveyor means associated with each said two bag fillers for directing said filled bags to a selected one of said two conveyor lanes, each conveyor lane has an outlet end associated with a respective bagging machine at a bagging station, said bagging machines being adapted to place said at least two of said bags into a pouch on a continuous basis during said working cycle, said bagging machines feeding a respective pouch closure device to close a mouth opening of said pouches, and discharge conveyor means for discharging said pouches, said spiral configuration provides for said outlet end of said conveyor belts to be elevated to feed said filled bags into a top loading end of said bagging machines, said bagging machines and pouch closure device being supported elevated from a floor surface for service access to an operator person.

8. A high speed bagging system as claimed in claim 7 wherein said two-lane conveyor has a bag receiving end for receiving bags with said product captive in said bag on a respective one of said conveyor belts, a receiving conveyor associated with each said bag fillers to feed bags to said diverting conveyor means for directing filled bags to said receiving end of said two conveyor lanes or both conveyor lanes to provide for continuous operation in the event one of said two bag fillers is inoperative.

9. A high speed bagging system as claimed in claim 7 wherein said spiral configuration is a circular loop configuration having an entry section and an outlet section disposed to define a travel path of approximately 360° between said entry and outlet sections.

10. A high speed bagging system as claimed in claim 7 wherein said bagging system is a continuous discharge system wherein said diverting conveyor section provides for directing filled bags to a dedicated one of said two bagging machines to permit servicing of a bagging machine while the other is operative.

11. A high speed bagging system as claimed in claim 10 wherein said two bag fillers are form, fill and seal liquid filler devices each capable of forming plastic film bags from an associated film supply roll, said service area containing an inventory of said film supply roll.

12. A high speed bagging system as claimed in claim 11 wherein said liquid filler devices are milk bag fillers.

13. A high speed bagging system as claimed in claim 11 wherein said film supply roll associated with each of said two bag fillers is a dedicated supply roll having printed label material on said film different from one another.

14. A high speed bagging system as claimed in claim 7 wherein said high speed bagging system is capable of processing up to 140 1.3 litre bags per minute when both said at least two bag filler and two bagging machines are operative.

15. A high speed bagging system as claimed in claim 7 wherein said conveyor lanes are inclined at an angle of from about 12° to about 20° and are disposed in substantially parallel spaced relationship.

16. A high speed bagging system as claimed in claim 7 wherein there are two of said bagging systems disposed side-by-side and defining a service area therebetween, said circular loop configuration being disposed on a side of a respective one of said common filler housing with said bagging station of each said two bagging systems disposed in parallel relationship to one another and on a respective one of opposed sides of said service area.

17. A high speed bagging system as claimed in claim 16 wherein there are at least an additional two of said bagging systems disposed side-by-side with said two bagging systems with said spiral configuration of adjacent housings of both said two systems disposed in overlapping relationship to optimize floor space area.

18. A high speed bagging system as claimed in claim 7 wherein said at least two bag fillers are housed in a common filler housing.

* * * * *